US010974098B2

(12) United States Patent
Zerbo et al.

(10) Patent No.: US 10,974,098 B2
(45) Date of Patent: Apr. 13, 2021

(54) RETRACTABLE HAND EXERCISER

(71) Applicant: D'Addario & Company, Inc., Farmingdale, NY (US)

(72) Inventors: Patrick Zerbo, Cold Spring Harbor, NY (US); Andrzej J. Krol, Wayne, NJ (US)

(73) Assignee: D'Addario & Company, Inc., Farmingdale, NY (US)

( * ) Notice: Subject to any disclaimer, the term of this patent is extended or adjusted under 35 U.S.C. 154(b) by 16 days.

(21) Appl. No.: 16/178,722

(22) Filed: Nov. 2, 2018

(65) Prior Publication Data

US 2019/0126095 A1 May 2, 2019

Related U.S. Application Data

(60) Provisional application No. 62/580,481, filed on Nov. 2, 2017.

(51) Int. Cl.
*A63B 23/16* (2006.01)
*A63B 21/00* (2006.01)
(Continued)

(52) U.S. Cl.
CPC ..... *A63B 23/16* (2013.01); *A63B 21/0004* (2013.01); *A63B 21/025* (2013.01);
(Continued)

(58) Field of Classification Search
CPC ..... A63B 23/16; A63B 23/03508; A63B 23/03541; A63B 21/0004; A63B 21/045; A63B 21/4043; A63B 21/4019; A63B 21/025; A63B 21/4025; A63B 21/153; A63B 21/065; A63B 2051/143; A63B 2022/185; A63B 29/08; A63B 37/0002; G09B 13/00; A41D 19/01547; A41D 19/01594; A61H 1/00; A61H 1/02; A61H 1/0285; A61H 1/0288; A61H 2205/065; A61H 2205/067; A61H 2201/0107; A61H 2201/0153; A61H 2201/0157;
(Continued)

(56) References Cited

U.S. PATENT DOCUMENTS 3,782,719 A * 1/1974 Kuhlman ..... A63B 23/16 482/48
4,114,875 A 9/1978 Deluty
(Continued)

*Primary Examiner* — Megan Anderson
*Assistant Examiner* — Kathleen Vermillera
(74) *Attorney, Agent, or Firm* — Alix, Yale & Ristas, LLP

(57) ABSTRACT

An exercise device includes a housing and one or more receptacles for receipt of a jointed body part, positioned to the outside of the housing, wherein each of the receptacles is biased toward the housing and independently repositionable away from the housing against a substantially constant bias force at all positions relative to the housing. In the disclosed finger exercising embodiment the housing includes a base defining a front surface for engagement with the fingers during retraction of the finger receptacles and an inner surface over which the cords pass toward the finger receptacles. A joint isolation element, such as a flexible band, is positioned at the front surface of the base, whereby the user keeps one or more fingers engaged with the housing while one or more other fingers can be extended against resistance.

21 Claims, 11 Drawing Sheets

(51) Int. Cl.
*A63B 21/045* (2006.01)
*A63B 23/035* (2006.01)
*A63B 21/02* (2006.01)

(52) U.S. Cl.
CPC ..... *A63B 21/045* (2013.01); *A63B 21/153* (2013.01); *A63B 21/4019* (2015.10); *A63B 21/4025* (2015.10); *A63B 21/4043* (2015.10); *A63B 23/03508* (2013.01); *A63B 23/03541* (2013.01)

(58) Field of Classification Search
CPC .... A61H 2201/1253; A61H 2201/1261; A61H 2201/1269; A61H 2201/14; A61H 2201/1418; A61H 2201/1436; A61H 2201/16; A61H 2201/1635; A61H 2201/1638; A61H 2201/165; A61H 2201/1652; A61H 2201/1657; A61H 2201/1664; A61H 2201/1666; A61H 2201/50
See application file for complete search history.

(56) References Cited

U.S. PATENT DOCUMENTS

| | | | | | |
|---|---|---|---|---|---|
| 4,483,330 | A * | 11/1984 | Jacobsen | A63B 21/015 | 242/378.4 |
| 4,779,866 | A | 10/1988 | Marshall et al. | | |
| 4,871,165 | A | 10/1989 | Marshall et al. | | |
| 5,451,191 | A * | 9/1995 | Beenken | A63B 23/16 | 482/47 |
| 5,733,231 | A * | 3/1998 | Corn | A63B 21/025 | 482/120 |
| 6,770,014 | B2 | 8/2004 | Amore | | |
| 7,137,936 | B1 * | 11/2006 | Shaw | A63B 21/025 | 482/127 |
| 7,935,035 | B2 | 5/2011 | Smith | | |
| 8,684,894 | B2 | 4/2014 | Flynn | | |
| 2003/0134728 | A1 * | 7/2003 | Wu | A63B 21/015 | 482/114 |
| 2014/0121078 | A1 * | 5/2014 | Lagree | A63B 21/025 | 482/127 |
| 2015/0011368 | A1 * | 1/2015 | Manor | A63B 21/0051 | 482/116 |

* cited by examiner

RETRACTABLE HAND EXERCISER

CROSS-REFERENCE TO RELATED APPLICATION

This application claims priority to U.S. Provisional Application No. 62/580,481 filed on Nov. 2, 2017 for "Retractable Hand Exerciser", the entire contents of which is incorporated herein by reference.

BACKGROUND

The disclosed embodiments relate to an exercise device. More particularly, the disclosure relates to a grip exercise device for extension exercises that provides a substantially constant or even resistance during use. The grip exercise device is occasionally referred to as a hand exercising device herein, but additional related portions of an individual's body related to grip strength may be exercised, including without limitation all portions of the hand, fingers, thumb, wrist and forearm without departing from the inventive nature of the device.

Devices exist for a variety of extension exercises for a variety of body parts (hands, arms, legs, etc.). Such "extension" exercises include exercises focusing on reaching or stretching. Known extension exercise devices utilize elastic materials, such as silicone or latex bands, that are stretched by a user during use to perform exercises. Stretching of the elastic materials in these devices provides a requisite resistance for the exercises, however the resistance provided increases exponentially the farther the elastic is stretched. This elastic property carries a significant drawback in that the increased resistance with stretching can lead to overcompensation and/or strain on the user's limbs or digits, which can lead to tendonitis or other health conditions. This is especially the case in elastic finger exercisers given the size and strength of fingers and hand joints, which are relatively small and weak compared to other limbs and joints in the body.

Additionally, known finger, hand or grip exercise devices commonly include a central body from which numerous elastic lines extend with finger receptacles on an opposite end. A user exercises with the device by holding the body in the palm of his hand, placing a finger or fingers in a respective receptacle, and stretching the finger(s) outward from the palm against the resistance of the elastic. Such devices can be helpful in strengthening certain joints in the fingers, however, they lack variability or adjustability to isolate certain joints or portions of a user's finger for concentration of exercises.

Thus, it would be useful to provide a hand or grip exerciser that reduces or eliminates these drawbacks. Such a device would provide a user with a constant resistance regardless of how far his finger, other digit or limb is extended and/or allow isolation of certain joints for focus of exercise.

SUMMARY

As use herein, the term "grip exerciser" should be understood as encompassing all portions of a limb, or jointed body part, such as the hand, fingers, thumb, wrist and forearm.

According to the present disclosure, an exercise device comprises a housing and one or more receptacles for receipt of a jointed body part, positioned to the outside of the housing, wherein each of the receptacles is biased toward the housing and independently repositionable away from the housing against a substantially constant bias force at all positions relative to the housing.

Preferably, the housing extends in a longitudinal direction, and a longitudinally extending retraction assembly is disposed within the housing defining an axis of rotation around which a plurality of wheels are rotatable independent of one another. A cord is wound around each wheel with a portion extending outside the housing, and a receptacle is attached to each cord. As the receptacles are repositioned away from the housing the receptacles are subject to the constant inward bias, from the retraction assembly.

In a further preference, each wheel is located between two brackets. Each bracket includes a shaft portion that extends coaxially into a wheel. For each wheel, a wound spring, such as a flat helical strip spring, is coaxially coiled between a shaft portion and an internal circumference within each wheel.

The housing is ergonomically shaped and adapted for exercising all or a subset of the digits. In the disclosed embodiment, the housing includes a base defining a front surface for engagement with the fingers during retraction of the finger receptacles and an inner surface over which the cords pass toward the finger receptacles. A joint isolation element, such as a flexible band, is positioned at the front surface of the base, whereby the user keeps one or more fingers engaged with the housing while one or more other fingers can be extended against resistance.

BRIEF DESCRIPTION OF THE DRAWINGS

FIG. 10 shows representative examples of a constant force spring for use within the exercise device; and.

DISCLOSURE OF THE INVENTION

In addition to the benefits and improvements disclosed herein, other objects and advantages of the disclosed embodiments will become apparent from the following wherein like numerals represent like parts throughout the several figures. Detailed embodiments of a retractable hand exerciser are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
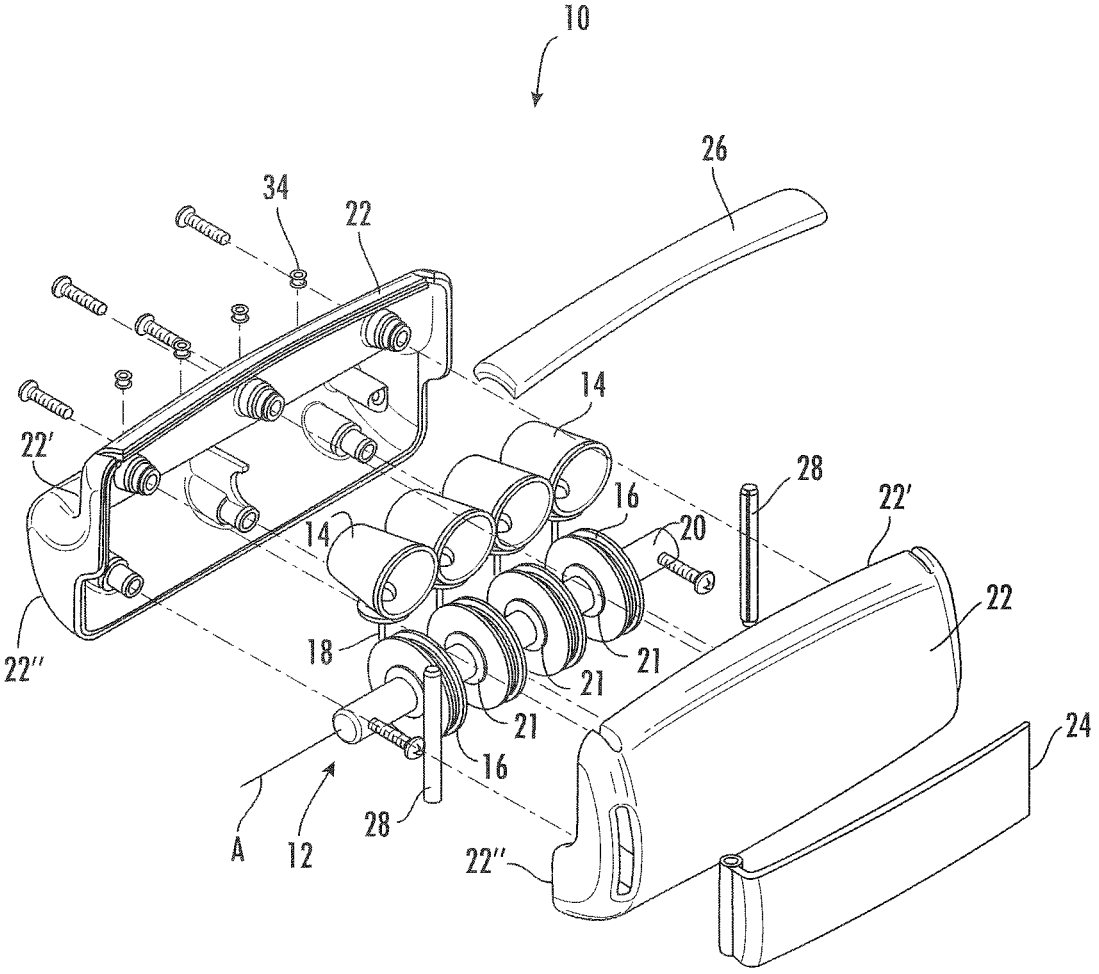
FIG. 1 is an exploded view of a hand exerciser according to the disclosure.
Figure 2:
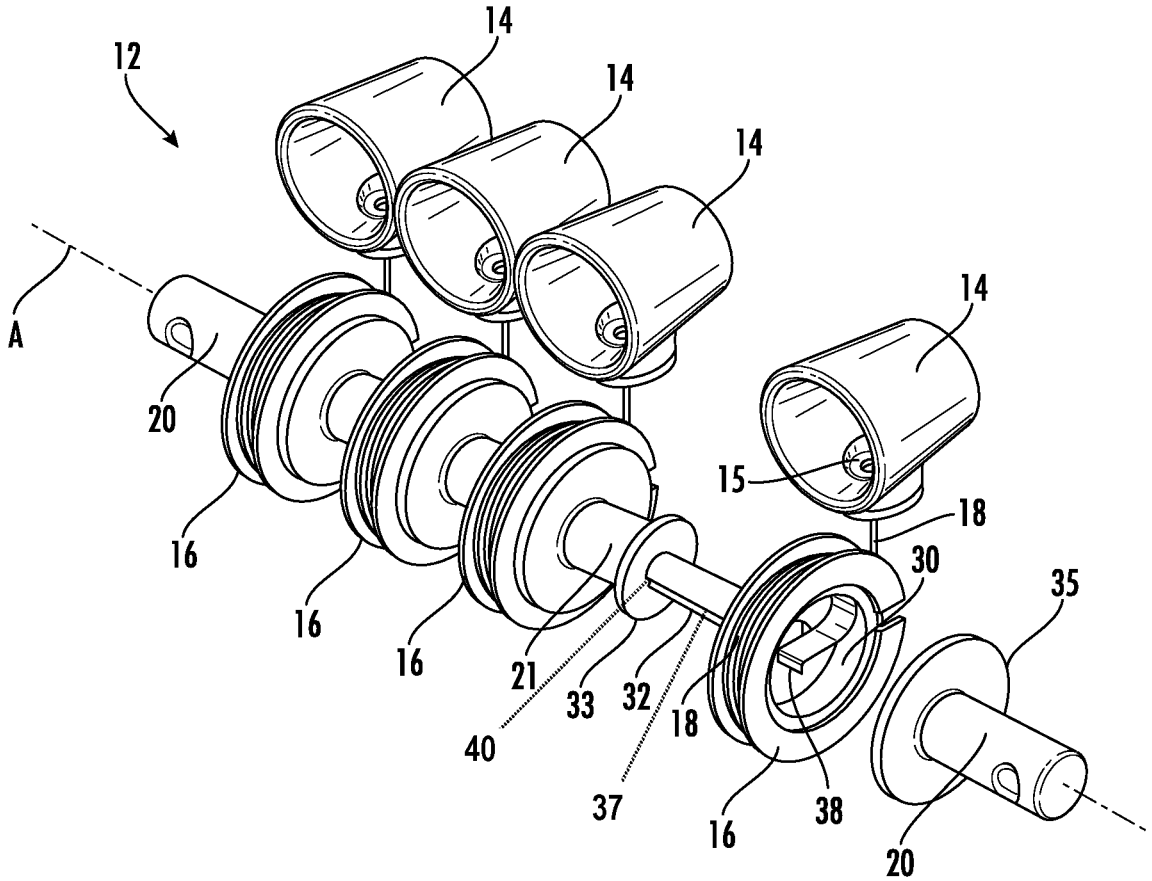
FIG. 2 is an exploded view of the retraction assembly of the hand exerciser of FIG. 1.
Figure 11:
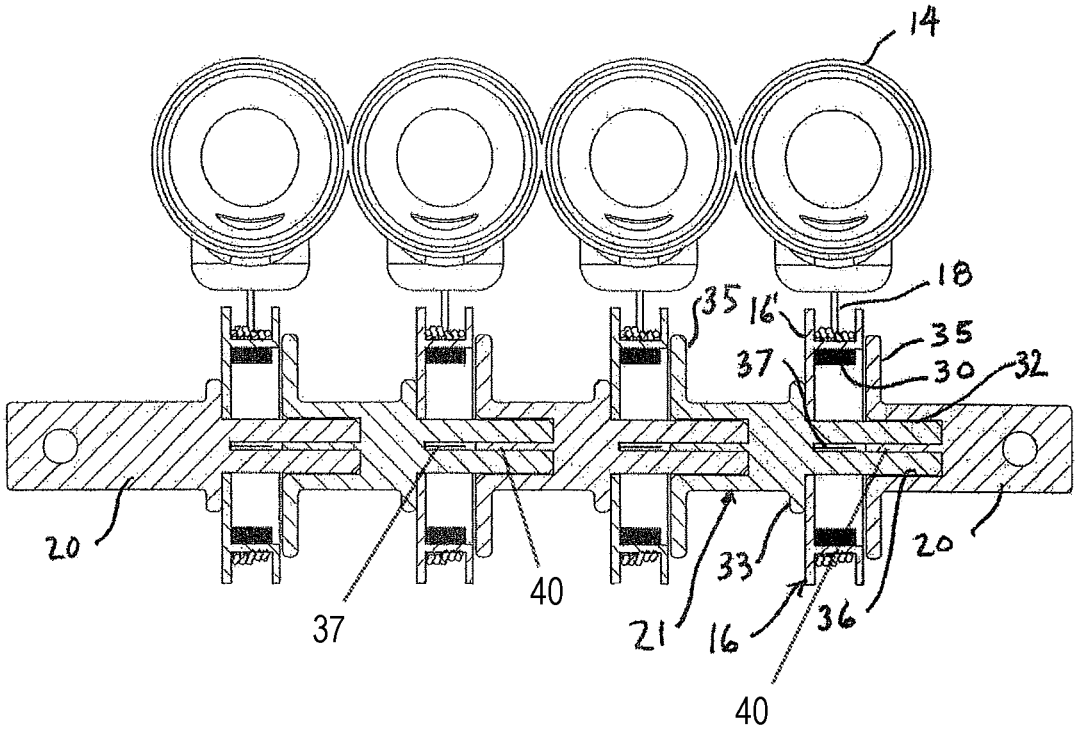
FIG. 11 is a detailed view of the relationship among the brackets, shafts, springs and wheels.

With reference to the disclosed drawings, a retractable hand (grip) exerciser 10 operates by way of a retraction assembly 12 with multiple rotating wheels 16, each of which winds a cord 18. The respective wheels 16 are operable independent of one another with bracket portions, 20 and 21, positioned on each side of each wheel 16 between adjacent wheels. As shown in FIGS. 1, 2 and 11, each end of the retraction assembly 12 has an end bracket 20 held in place in the housing 22 by a lateral fastener. An intermediate bracket 21 is positioned coaxial to the end brackets 20 between each wheel 16. The brackets 20 and 21 combine to stack and hold the wheels 16 longitudinally within the housing 22 and define an axis A of rotation around which the wheels 16 rotate when the exerciser 10 is in use. As shown, each of the intermediate brackets 21 includes a central shaft 32 with opposite annular flanges 33 to hold the wheels in place. Each of the end brackets 20 includes an annular flange 35 for abutting the adjacent wheel 16 and a central opening 36 for receiving a portion of the shaft 32 of the adjacent intermediate bracket 21. The configuration of the separate brackets, 20 and 21, allows independent rotation of each wheel relative to the other wheels.

Figure 10:
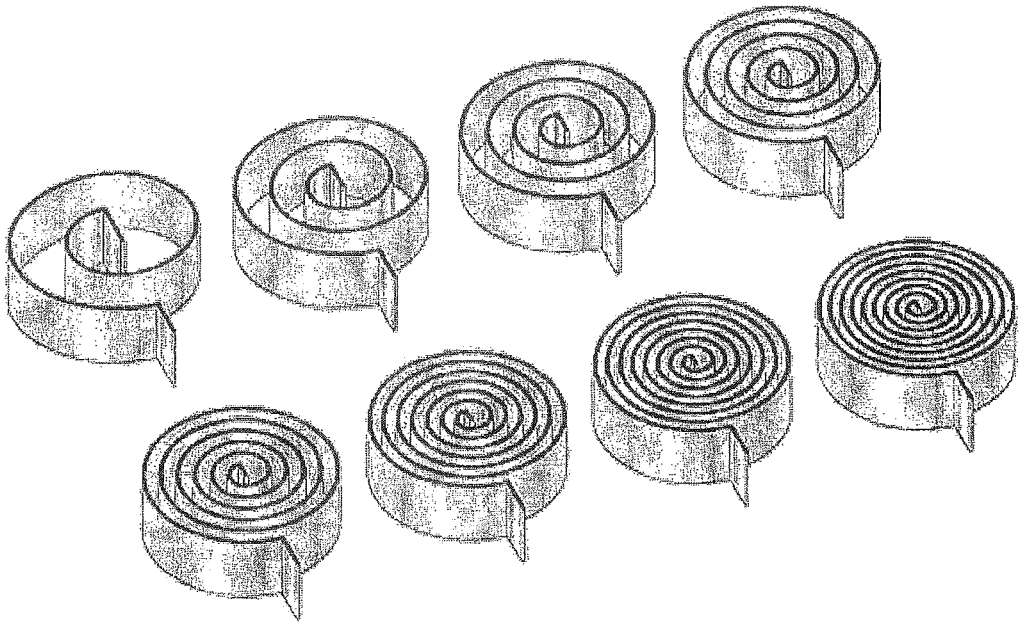

Each wheel 16 includes an inner constant force spring 30 biasing the respective wheel in a rotational direction to retract its cord 18 and draw a finger receptacle 14 toward the housing 22 (as will be described in greater detail below). Representative constant force springs 30 (uniform force vs. displacement rate) as known in the art are shown in FIG. 10 for illustrative purposes. Generally, the springs 30 comprise a thin flat strip of metal wound in a spiral pattern. The springs 30 are attached to a portion of the bracket shaft 32 on the inside of each wheel 16 coaxial thereto to bias the wheel in one rotational direction. As the wheel 16 is rotated against the bias (i.e., by a user extending a finger receptacle 14 to unwind a cord 18 from a wheel 16), the winding bias provided on the wheel 16 remains substantially constant. This means that the resistance force experienced by the user is substantially constant at all positions of the finger receptacle relative to the housing. By "substantially constant," it is meant that the force of retraction on the cord, and thus, the extension force required to continue moving the finger receptacle, does not significantly change at different points relative to the housing along the path of extension.

FIG. 11 should be considered in combination with FIG. 2, as a more detailed view of the relationship among the brackets 20, 21; shafts 32; springs 30; and wheels 16. The shaft 32 at one (e.g., right) side of representative bracket 21 passes through the axis of wheel 16 and into the axial opening 36 in the corresponding other (e.g., left) side of the next bracket 20 where it engages a mating feature or projection 40. Slot 37 in shaft 32 receives one end 38 of spring 30 and the other end of the spring is fixed against the inside circumference of the wheel 16. The slots have dual purposes. They axially lock all the brackets 20, 21 together with the mating feature or projection 40, preventing them from rotating, and also serve as anchor points for the spring coils.

Wheel 16 has one substantially solid side 16' that is contacted for axial support by the smaller flange 33 on bracket 21 and an open other side that is closed and supported axially by the large flange 35 on bracket 20. The open side facilitates mounting of the spring 30 during assembly. The outer circumference of wheel 16 includes a channel for guiding cord 18.

Only reel wheel 16 is free to rotate, about its respective shaft 32. As the wheels rotate one way from the rest or neutral position in response to the pull of each cord 18, the anchored springs 30 wind up creating exercise tension/resistance. Upon release of the exercise tension, the springs rotate the wheels the other way, which retracts the cords and returns the wheels to a rest position.

The cords 18 are typically made from nylon or another durable cord material that is non-elastic with a distal portion of each cord 18 extending through a hole in a receptacle 14 and held in place with an inner bushing 15. The receptacle is preferably a truncated cone, resembling a thimble, with the cord 18 attached to the sidewall. This particular attachment mechanism is non-limiting to the inventive concepts disclosed herein. While the winding bias provided to each wheel is substantially constant at all points of rotation, each wheel can be biased with a different amount of force relative to other wheels.

With reference to the exploded view of FIG. 1, the retraction assembly 12 is contained within a housing 22 which is shown in two halves. One half of the housing includes a longitudinal indentation 42 for ergonomic purposes and ease of use. When the device is assembled, the finger receptacles 14 are positioned to the outside of the housing 22 (on top in the view shown in FIG. 1) with each cord 18 extending through a respective opening in the housing. A grommet, like those shown as reference numeral 34 in FIG. 1, may be provided in the housing to form a guide passage for each cord 18.

Additionally, a holder element 24 extends longitudinally across one side of the housing 22. A longitudinally extended joint isolation element 26 is attached at the bottom side 44 of the housing 22 in front of the primary openings in the finger receptacles 14 (top/bottom designation relative to FIGS. 3, 6, 7 and 8). In the depicted embodiment, each of the holder element 24 and joint isolation element 26 is an elastic band. When operating the exercise device 10, a user typically slides his fingers between the holder element 24 and the housing with his thumb on the opposite side of the housing. As will be described below and shown with reference to FIGS. 3-9, the user can optionally slip one or more fingers underneath the joint isolation element 26 to concentrate extension exercises on a particular finger joint by blocking other joints from use. Each of the holder element 24 and joint isolation element 26 can be adjustable in terms of tightening or loosening, and/or can be replaced with another type of strap or similar element for holding the hand or fingers in the operative positions. As also shown in FIG. 1, in this embodiment, the holder element 24 (elastic band) is held in place relative to the housing 22 by a pair of opposing spring pins 28.

Figure 3:
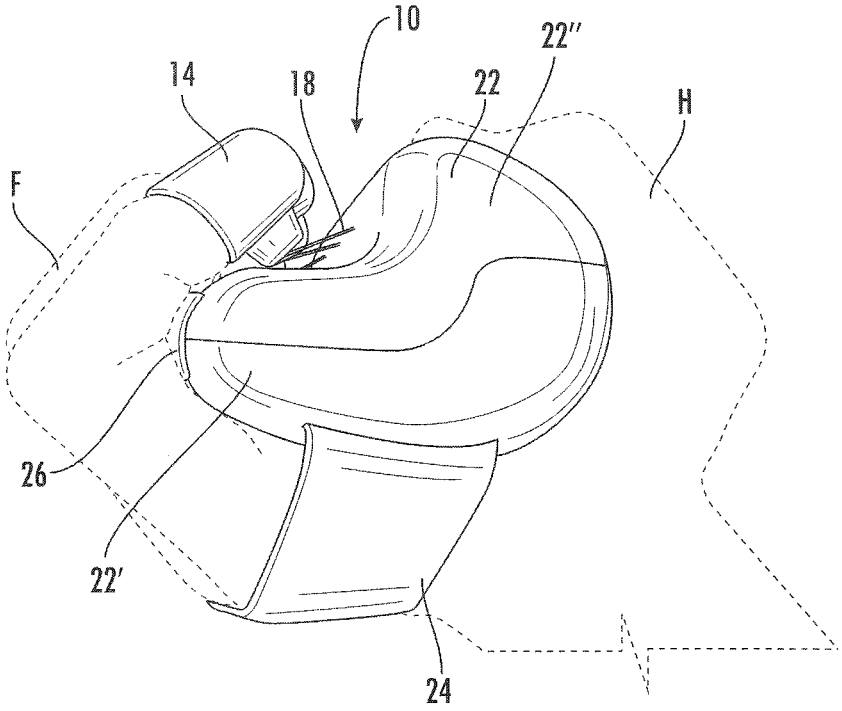
FIG. 3 is a view depicting the disclosed hand exerciser in use in a retracted position.

FIGS. 1-9 illustrate exemplary uses of the device 10. FIG. 3 shows the device 10 in a user's hand H with fingers F in the receptacles 14 in a retracted position against the housing 22 (i.e., the cords 18 holding the receptacles 14 are substantially wound around their respective wheel 16). The assembled housing 22 resembles a stylized bench, with the outer surface of base portion 22' adapted to nest in and conform to the user's palm and the outer surface of riser portion 22" adapted to conform to the user's overlapped thumb. In the non-use, stored condition and in the initial, retracted position of the fingers, the receptacles 14 confront the front or inner (top) surface of base portion 22'. The base 22' defines a front surface 46 for engagement with the fingers, whereas the cords 18 pass over the inner surface of the base portion 22' and penetrate the inner (front) surface of riser portion 22", which is transverse to the inner surface of the base portion. The cords 18 exit the housing through the front of riser portion 22" of the housing, tangentially from the portions of the wheel circumferences that are within the riser portion.

As shown, the joint isolation element 26 is not engaged; the user simply holds the elastic band against the front of the base portion 22' of the housing while inserting his fingers F into the receptacles 14. As can also be appreciated, the inside surfaces of the housing 22 opposite the holder elastic 24 defines an indented ergonomic surface 42 for assisting holding and using the device 10.

Figure 4:
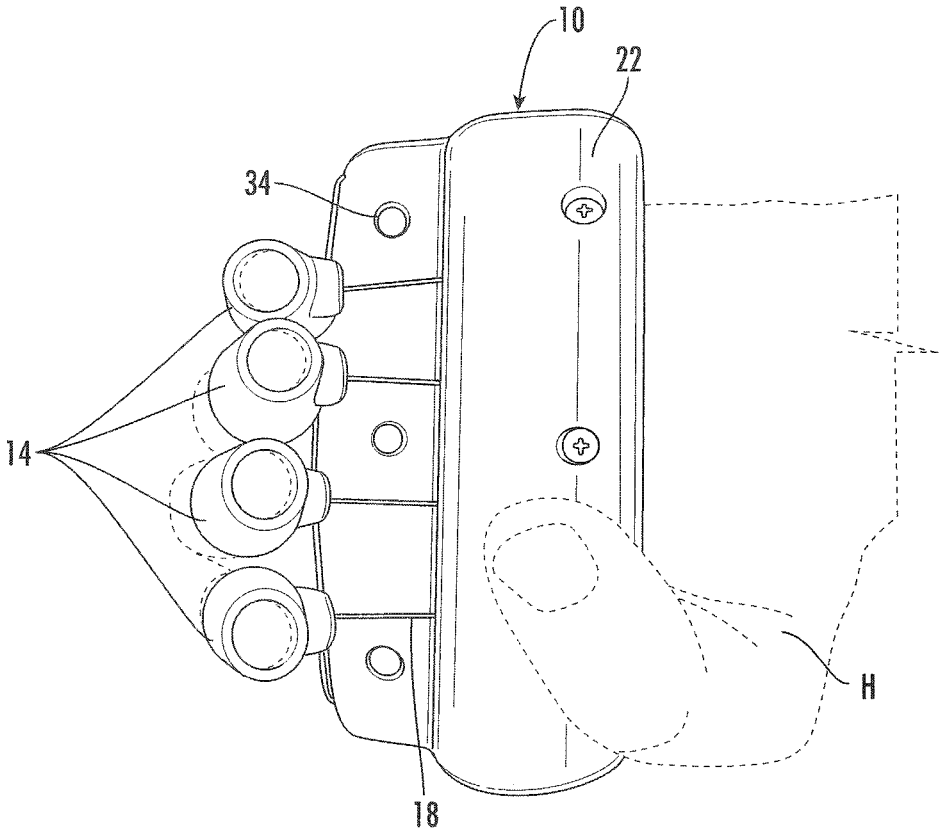
FIG. 4 is a view depicting the disclosed hand exerciser in use in the retracted position from another view.

FIG. 4 shows a bottom view of the device 10 with the receptacles 14 in the retracted position and the joint isolation element 26 not engaged.

Figure 5:
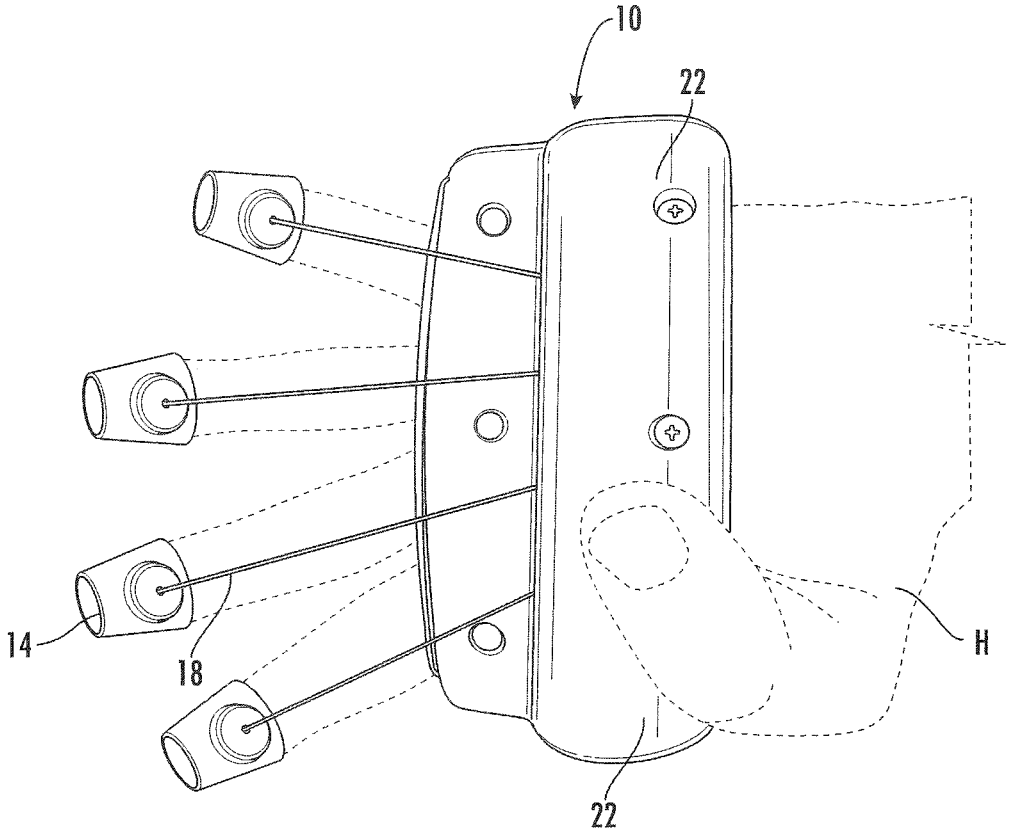
FIG. 5 is a view depicting the disclosed hand exerciser in an extended position.

FIG. 5 shows a bottom view of the device 10 with the receptacles 14 in an extended position and the joint isolation element 26 not engaged. As shown, the receptacles 14 have been brought to the extended position by the user extending his fingers F, thereby causing the cords 18 to unwind from the wheels against the bias from the constant force spring 30 (on interior of housing).

Figure 6:
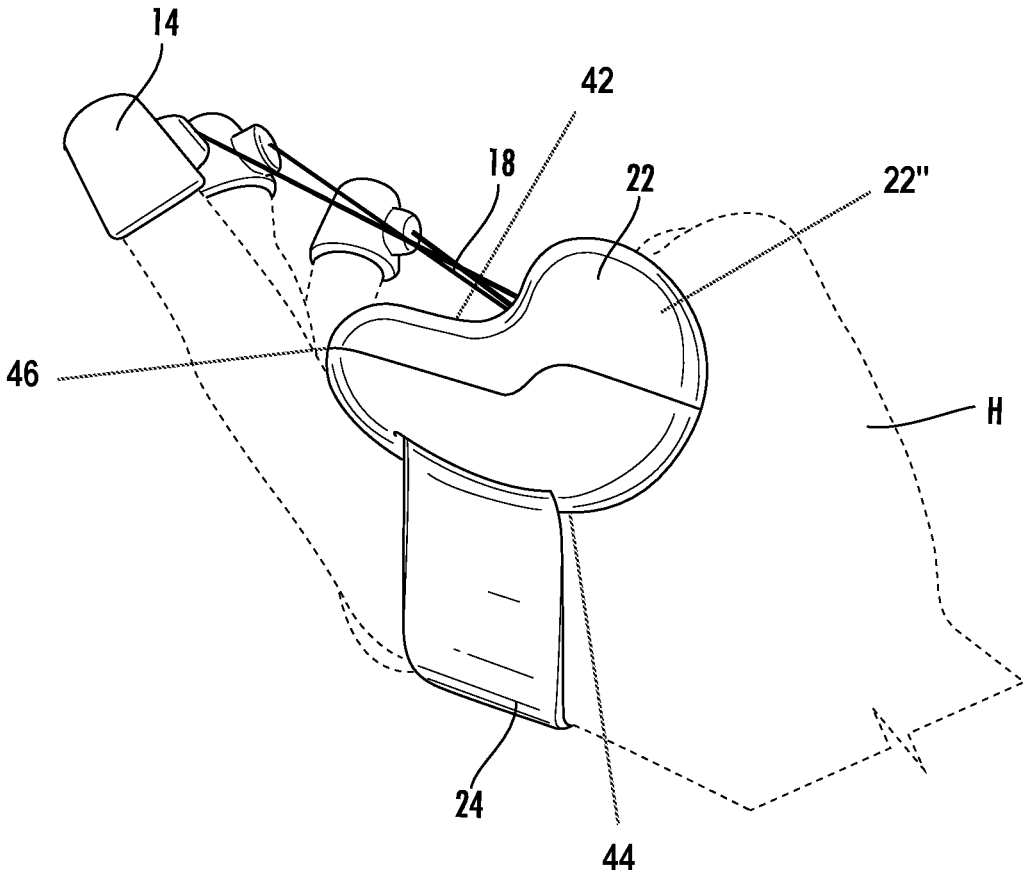
FIG. 6 is a view depicting the disclosed hand exerciser in the extended position from another view.

FIG. 6 is a side view of the device 10 with the receptacles 14 brought to the extended position against the bias from the constant force spring 30.

Figure 7:
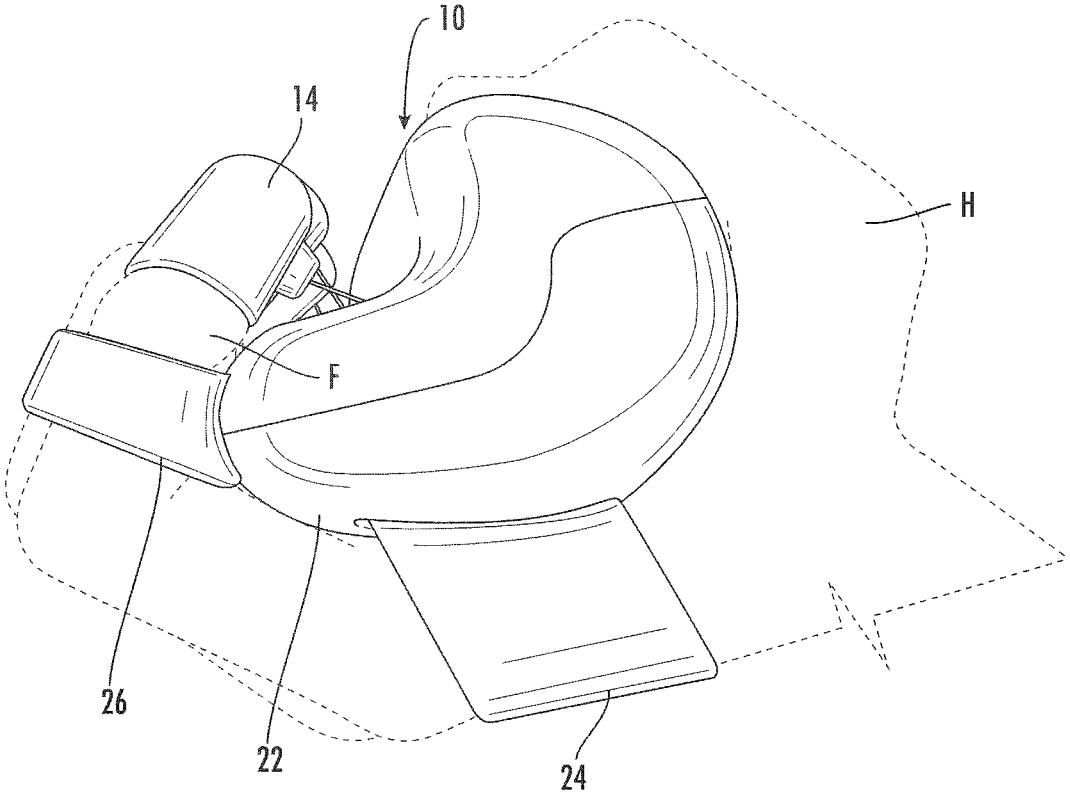
FIG. 7 is a view depicting the disclosed hand exerciser in use with a joint isolation element engaged and in a retracted position.

FIG. 7 shows the device 10 with the receptacles 14 in the retracted position. In FIG. 7, the user engages the joint isolation element 26 by slipping his fingers F between the top surface of the housing and the elastic element 26 to block proximal joints in his fingers F.

Figure 8:
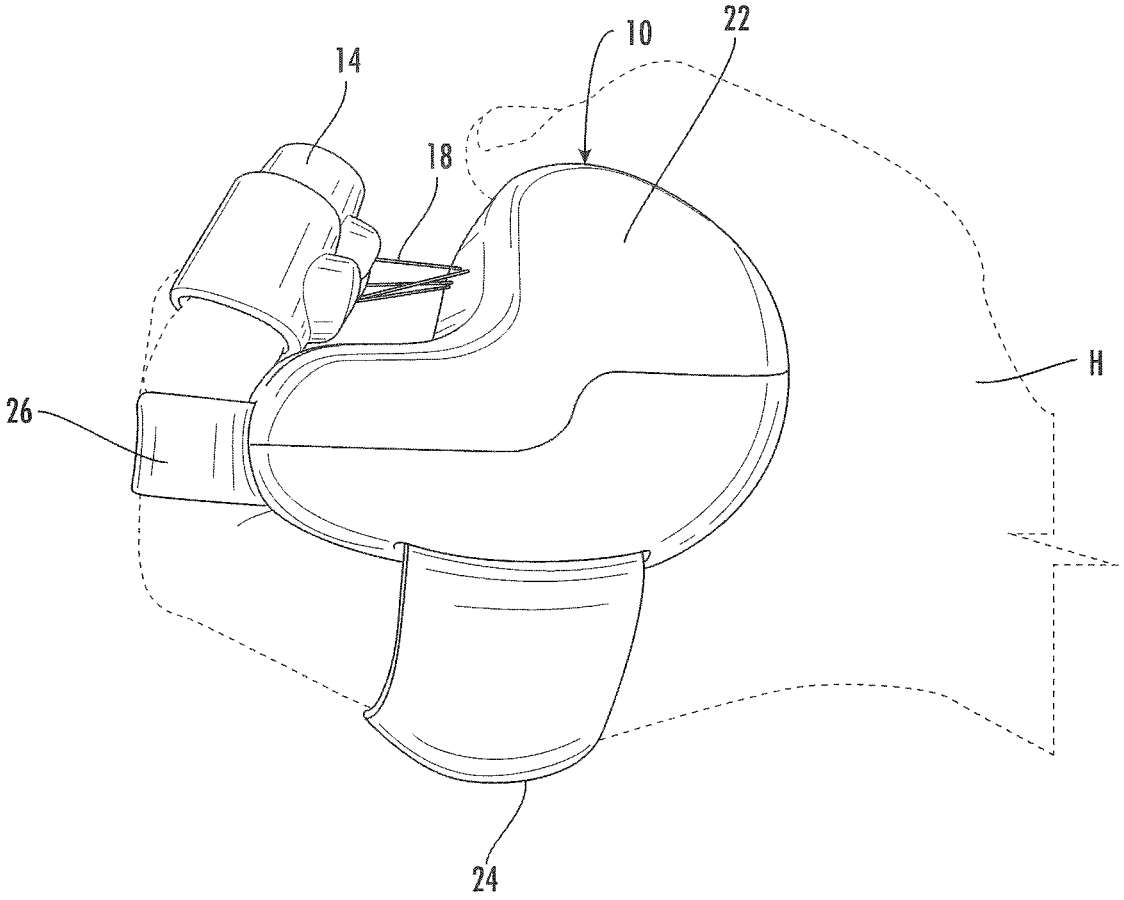
FIG. 8 is a view depicting the disclosed hand exerciser in use with a joint isolation element engaged and in an extended position.

FIG. 8 shows the device 10 with the joint isolation element 26 engaged and in the extended position.

Figure 9:
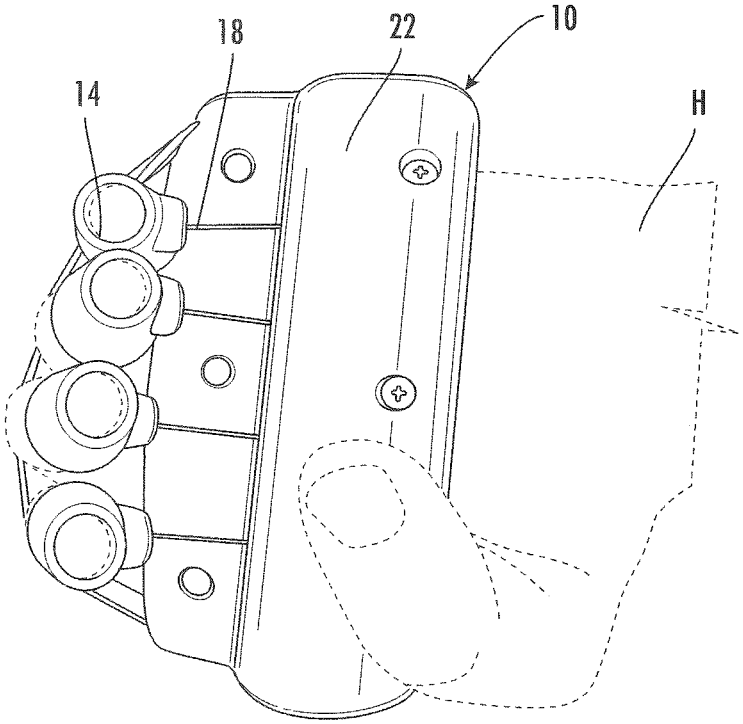
FIG. 9 is a view depicting the disclosed hand exerciser in use with a joint isolation band engaged and in the extended position.

FIG. 9 shows the device 10 with the joint isolation element 26 engaged and in the extended position from a bottom view.

Since each wheel 16 is allowed to rotate independent of the other wheels via the independent bracket portions, 20 and 21, a user has the option to (1) exercise one or more fingers or a thumb without exercising others, and/or (2) use the joint isolation feature on one or more fingers without exercising others. Since each wheel can rotate independent of the other wheels, it also provides variability for users with different sized fingers possibly having different strengths. Necessarily, individual fingers will extend further than others from the axis A during exercises simply due to their differing lengths.

As discussed above, the joint isolation element or elastic 26 allows the user to block specific joints, including the DIP (top joint of a finger) and PIP (middle joint of a finger). Blocking one or more of these joints allows the user to specifically isolate another joint for development and improvement of strength, dexterity, endurance, circulation and range of motion.

The disclosed device 10 utilizes retractable-based resistance to strengthen and condition both the intrinsic and extrinsic muscle groups to maximize extensor tendon gliding, smooth joint motion, coordination and muscle function in the fingers, hand and forearm. With the adjustability provided, the device 10 can be used for rehabilitation of a variety of hand, finger, wrist and/or forearm conditions, including carpal tunnel, stroke, fractures, tendon injuries, nerve lacerations, and tennis or golf elbow. It can also be used by athletes, musicians or other individuals for building strength, endurance, dexterity and increased circulation and range of motion.

Table 1 below presents the main elements that form the disclosed exerciser 10 and the materials from which each is made in the preferred embodiment of FIGS. 1-9.

TABLE 1

| No. | Element | Material |
|---|---|---|
| 14 | Finger receptacle | Silicone rubber |
| 15 | Bushing | Polymer |
| 16 | Wheel | Polymer |
| 18 | Cord | Braided cord |
| 20, 21 | End and intermediate brackets | Polymer |
| 22 | Housing | Polymer |
| 24 | Holder element | Braided elastic band |
| 26 | Joint isolation element | Braided elastic band |
| 28 | Spring pin | Steel |
| 30 | Constant force spring | Steel |
| 34 | Grommet | Steel |

Table 1 is presented for illustrative purposes only and non-limiting in scope, as many of the elements can be formed from different materials without impacting the inventiveness of the hand exerciser 10.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. An exercise device, comprising:

a housing defining an inside and an outside;

a retraction assembly positioned on the inside of the housing and including a plurality of retraction wheels positioned coaxial to one another along a longitudinal axis around which each of the plurality of retraction wheels is rotatable independently from the other of the plurality of retraction wheels, a plurality of cords, each of the plurality of retraction wheels winding a respective cord of the plurality of cords with a portion of each of the plurality of cords extending through the housing to the outside; and a plurality of receptacles, wherein each of the plurality of receptacles is attached to a respective cord of the plurality of cords outside the housing, and thereby operatively connected to a respective retraction wheel of the plurality of retraction wheels, wherein each of the plurality of receptacles is biased towards a retracted position by its respective retraction wheel and configured to engage a portion of a finger of an individual; wherein each of the plurality of retraction wheels is biased in a rotational direction independent of one another, each of the plurality of receptacles is configured to be independently moved to an extended position against a substantially constant bias force provided by the respective retraction wheel around which the respective cord is wound, and the housing includes a base defining (i) a front surface for engagement with one or more fingers of the individual when engaged with a respective receptacle of the plurality of receptacles during retraction of one or more of the plurality of receptacles and (ii) an inner indented surface over which each of the plurality of cords passes toward the plurality of receptacles, and a rear riser portion extending from the base portion past the inner indented surface.

2. The exercise device of claim 1, further comprising a joint isolation element positioned at the front surface of the base, the joint isolation element being selectively engageable by one or more of the fingers of the individual.

3. The exercise device of claim 2, wherein the joint isolation element is an elongated band extending substantially parallel to the longitudinal axis.

4. The exercise device of claim 3, wherein the elongated band is configured to allow the individual to selectively block one or more proximal joints in one or more of the plurality of fingers by positioning the respective one or more of the plurality of fingers between the elongated band and the base of the housing with each of the respective one or more of the fingers engaged with one of the plurality of receptacles.

5. The exercise device of claim 1, wherein each of the plurality of retraction wheels is respectively sandwiched between two axially spaced apart flanges that are rotatably fixed relative to one another.

6. The exercise device of claim 5, wherein at least one of the two axially spaced apart flanges is formed on a bracket with an axially extending rotationally fixed shaft with a portion of the rotationally fixed shaft extending into the respective wheel of the plurality of wheels, the portion of the rotationally fixed shaft incudes a slot located within the respective wheel of the plurality of wheels into which the portion extends, and a wound spring is coaxially coiled between the portion of the rotationally fixed shaft and an internal circumference within the respective wheel of the plurality of wheels and the wound spring is attached to said slot.

7. The exercise device of claim 1, wherein the substantially constant bias force is provided by a constant force spring operatively attached to each respective retraction wheel of the plurality of retraction wheels.

8. The exercise device of claim 1, wherein each of the plurality of cords extends from the rear riser portion of the housing.

9. An exercise device, comprising:

an elongate housing extending in a longitudinal direction and defining an outer surface;

a longitudinally extending retraction assembly defining an axis of rotation around which each of a plurality of wheels is rotatable independent of the other of the plurality of wheels, the retraction assembly being concealed within the elongate housing;

a plurality of cords, wherein each of the plurality of cords is wound around a respective wheel of the plurality of wheels with a portion of each of the plurality of cords extending outside the elongate housing;

a plurality of receptacles, wherein each of the plurality of receptacles is attached to a respective cord of the plurality of cords and positioned outside the elongate housing, each of the plurality of receptacles being configured to engage with a jointed body part; and a joint isolation element extending longitudinally along the outer surface of the elongate housing, wherein the outer surface of the elongate housing includes a base portion that extends longitudinally and transversely from one end to an opposite front surface configured to engage the jointed body parts during retraction of the plurality of receptacles when each of the jointed body parts is engaged with a respective receptacle of the plurality of receptacles, the front surface of the elongate housing transitions inward to a top indented surface of the elongate housing over which the plurality of cords passes toward the plurality of receptacles, the elongate housing includes a rear riser portion extending from the base portion in the direction of the top indented surface, the rear riser portion terminating at an upper position above the top indented surface, the joint isolation element is positioned along the front surface of the elongate housing, and as the plurality of receptacles are repositioned extended away from the elongate housing, each of the plurality of receptacles is subject to a substantially constant inward bias from the retraction assembly at all positions of extension.

10. The exercise device of claim 9, wherein each wheel of the plurality of wheels is respectively sandwiched between two spaced apart flanges in a rotationally independent relationship.

11. The exercise device of claim 10, wherein each of the two spaced apart flanges is rotationally locked relative to one another.

12. The exercise device of claim 9, wherein the substantially constant inward bias on each of the plurality of receptacles receptacle is provided by a constant force spring operatively engaged with each respective wheel of the plurality of wheels.

13. The exercise device of claim 9, wherein the substantially constant inward bias is provided by a rotational bias force on each of the plurality of wheels, and wherein the rotational bias force of each wheel of the plurality of wheels is the same.

14. The exercise device of claim 9, wherein the substantially constant inward bias is provided by a rotational bias force on each of the plurality of wheels and at least one wheel of the plurality of wheels experiences a rotational bias force that is different from the rotational bias force of one or more other wheels of the plurality of wheels.

15. The exercise device of claim 9, wherein each of the plurality of wheels is respectively located between two opposite brackets, a rotationally fixed shaft portion of one of the two opposite brackets extends coaxially into the respective wheel of the plurality of wheels that is located between the two opposite brackets, and a wound spring is coaxially coiled between said rotationally fixed shaft portion and an internal circumference within the respective wheel of the plurality of wheels.

16. The exercise device of claim 9, wherein the retraction assembly comprises a plurality of brackets rotationally fixed to one another, wherein each of the plurality of wheels abuts one of the plurality of brackets, wherein a shaft portion of the respective one of the plurality of brackets extends axially through the respective wheel of the plurality of wheels, the shaft portion includes a slot positioned axially within the respective wheel of the plurality of wheels through which it extends, a wound spring is coaxially coiled between the shaft portion and an internal circumference within the respective wheel of the plurality of wheels, and the wound spring is attached to said slot of the shaft portion.

17. An exercise device comprising:

a housing extending in a longitudinal direction and delimiting an inside from an outside;

a plurality of receptacles, each of the plurality of receptacles being configured to receive a jointed body part and being positioned to the outside of the housing:

a longitudinally extending retraction assembly concealed within the inside of the housing defining an axis of rotation around which each of a plurality of wheels is rotatable independent of the other wheels in the plurality of wheels;

a plurality of cords with each of the plurality of cords being wound around one of the plurality of wheels with a portion of each of the plurality of cords extending outside the housing and being attached to one of the plurality of receptacles;

a joint isolation element extending longitudinally along an outer surface of the elongate housing, wherein each of the plurality of receptacles is biased toward the housing and independently repositionable away from the housing against a substantially constant bias force at all positions relative to the housing, as one or more of the plurality of receptacles is repositioned away from the housing, each of the one or more of the plurality of receptacles is subject to said substantially constant inward bias from the retraction assembly, and the housing includes a longitudinally extending base portion defining a front surface configured to engage with the jointed body parts during retraction of one or more of the plurality of receptacles, and the joint isolation element is positioned extending along the front surface and is selectively engageable by one or more of the jointed body parts of the individual.

18. The exercise device of claim 17, wherein the housing includes an inner surface over which each of the plurality of cords passes toward the plurality of receptacles and a rear riser portion extending transversely from the base portion past the inner surface, and wherein a portion of each of the plurality of wheels is situated within the rear riser portion of the housing and each of the plurality of cords exits the housing through the rear riser portion of the housing tangentially from said portion of each of the plurality of wheels around which each respective cord of the plurality of cords is wound.

19. The exercise device of claim 17, wherein the housing is formed of a polymer material.

20. The exercise device of claim 17, wherein each of the plurality of wheels is respectively located between two opposite brackets, a rotationally fixed shaft portion of one of the two opposite brackets extends coaxially into the respective wheel of the plurality of wheels that is located between the two opposite brackets, and a wound spring is coaxially coiled between said rotationally fixed shaft portion and an internal circumference within the respective wheel of the plurality of wheels.

21. The exercise device of claim 17, wherein each of the plurality of cords exits the housing through a riser portion of the housing.

* * * * *